US009103583B2

(12) United States Patent
Athanasiou

(10) Patent No.: US 9,103,583 B2
(45) Date of Patent: Aug. 11, 2015

(54) APPARATUS AND SYSTEM FOR CLEANING A WATER LINE

(75) Inventor: Athanasios Athanasiou, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 82 days.

(21) Appl. No.: 13/583,230

(22) PCT Filed: Feb. 24, 2011

(86) PCT No.: PCT/EP2011/052717
§ 371 (c)(1),
(2), (4) Date: Sep. 7, 2012

(87) PCT Pub. No.: WO2011/113673
PCT Pub. Date: Sep. 22, 2011

(65) Prior Publication Data

US 2012/0325333 A1 Dec. 27, 2012

(30) Foreign Application Priority Data

Mar. 19, 2010 (DE) ..... 10 2010 003 090

(51) Int. Cl.
*B08B 9/032* (2006.01)
*F25D 23/12* (2006.01)
*B08B 9/027* (2006.01)

(52) U.S. Cl.
CPC ..... *F25D 23/126* (2013.01); *B08B 9/027* (2013.01); *B08B 9/032* (2013.01); *F25C 2400/10* (2013.01); *F25C 2400/14* (2013.01); *F25D 2400/22* (2013.01); *Y10T 137/4245* (2015.04)

(58) Field of Classification Search
CPC ..... B08B 9/0323; B08B 9/027; B08B 9/032; C02F 1/688; C02F 2201/00; C02F 2201/006; C02F 2201/007; C02F 2103/02; C02F 2103/023; B01F 1/0038; F25D 2323/0024; F25D 2317/00; F25D 2317/04; F25D 2317/041; F25D 23/126; F25C 2400/14; B01D 27/08; B01D 27/10; B01D 27/103; B01D 27/108
USPC ..... 137/268, 15.04, 15.05, 240; 422/264, 422/282; 210/206, 209, 446
See application file for complete search history.

(56) References Cited

U.S. PATENT DOCUMENTS 1,176,126 A * 3/1916 Benedict ..... 422/282
2,120,865 A 6/1938 Kleman
2,573,576 A * 10/1951 Klumb ..... 422/266
2,770,317 A * 11/1956 Botttum ..... 96/147

(Continued)

FOREIGN PATENT DOCUMENTS

DE 10056253 A1 5/2002

OTHER PUBLICATIONS

International Search Report PCT/EP2011/052717, mailed Jun. 12, 2011.

*Primary Examiner* — Kevin Lee
(74) *Attorney, Agent, or Firm* — Nixon & Vanderhye, P.C.

(57) ABSTRACT

Apparatus for cleaning an internal water line of a household appliance, in particular of a refrigerating device, includes a chamber which contains a cleaning substance or can be filled with the cleaning substance. An inlet connection is in communication with the chamber and configured identical to an inlet connection of the internal water line, and an outlet connection is in communication with the chamber and configured to complement the inlet connection of the apparatus.

35 Claims, 2 Drawing Sheets

(56) References Cited

U.S. PATENT DOCUMENTS

| | | | | | |
|---|---|---|---|---|---|
| 2,955,028 | A | * | 10/1960 | Bevans | 137/268 |
| 3,320,964 | A | | 5/1967 | Tripp | |
| 3,389,716 | A | | 6/1968 | Wilburn | |
| 3,828,983 | A | * | 8/1974 | Russo | 137/268 |
| 5,402,813 | A | * | 4/1995 | Keen | 137/15.16 |
| 6,550,496 | B2 | * | 4/2003 | Tiemann et al. | 137/625.46 |
| 6,698,226 | B1 | | 3/2004 | Mahloch | |
| 6,855,252 | B2 | * | 2/2005 | Brandreth, III | 210/206 |
| 7,393,450 | B2 | * | 7/2008 | Silveri | 137/268 |
| 7,591,279 | B2 | * | 9/2009 | Martin et al. | 137/268 |
| 2006/0226170 | A1 | | 10/2006 | Larsen | |
| 2008/0223410 | A1 | | 9/2008 | Molloy et al. | |
| 2011/0030412 | A1 | | 2/2011 | Kim | |

* cited by examiner

APPARATUS AND SYSTEM FOR CLEANING A WATER LINE

This application is a U.S. National Phase of International Patent Application No. PCT/EP2011/052717, filed Feb. 24, 2011, which designates the U.S. and claims priority to German Patent Application No. DE 10 2010 003 090.2, filed Mar. 19, 2010, the entire contents of each of which are hereby incorporated by reference.

BACKGROUND OF THE INVENTION

The present invention relates to a method and an apparatus for cleaning an internal water line of a household appliance, in particular of a refrigerating device.

Refrigerating devices with an integrated ice-maker and/or cold water dispenser are enjoying increasing popularity. Refrigerating devices of this type usually have an internal water line which is connected to a mains water supply network in order to be able to immediately refill an integrated storage container of the cold water dispenser or a molded tray of the ice maker after each withdrawal, so that sufficient cold water or ice is available at any time. The water outlet points of the water dispenser and/or the ice maker are usually not provided with a hermetically closing stop valve, thereby rendering it possible for germs to spread from these water outlet points into the storage container and/or the internal water line of the device. It is therefore desirable to clean this internal water line from time to time. Such cleaning must usually be carried out by the service department of the refrigerating device manufacturer and is therefore both complicated for a user to organize and costly.

BRIEF SUMMARY OF THE INVENTION

The object of the present invention is to also render the cleaning of an internal water line of a household appliance simple and cost-effective for the user.

The object is achieved on the one hand by a method for cleaning an internal water line having the steps:

- inserting a chamber containing a cleaning substance between an external water line and the internal water line of the device, and
- drawing off water at an outlet of the internal water line, until the cleaning substance is flushed through the internal water line.

A further object of the invention is an apparatus for implementing this method. The apparatus includes a chamber in accordance with a first simple embodiment, which contains the cleaning substance or can be filled with the same and which comprises an inlet connection which is identical to an inlet connection of the internal water line and an outlet connection which complements the inlet connection. A user can easily insert such an apparatus between the external and internal water line and allow water to flow therethrough until this has flushed the cleaning substance completely out of the chamber and through the internal water line. The chamber can then be removed again or, after the cleaning substance has been completely flushed out and does not hinder the flow of water, it can remain therein until it is refilled or replaced within the scope of a new cleaning process.

A filter is preferably arranged between the chamber and the complementary connection of the apparatus in order to retain solid particles in the cleaning substance in the chamber until they are completely dissolved or their particle size is reduced to such a degree that after passing through the filter during their passage through the internal water line they completely dissolve.

A destructible membrane can be arranged between the chamber and at least one of the connections. This is then particularly expedient if the apparatus with a filled chamber is to be marketed as disposable in order to ensure that the cleaning substance remains in the chamber until the apparatus is used.

The membrane may in particular be destroyed by the water pressure acting during use. This allows a user to insert the apparatus with the intact membrane between an external and internal water line, so that leakage of the cleaning substance is ruled out during assembly. It is then sufficient to place the external line under pressure, in order to destroy the membrane so that the cleaning substance can be flushed out by the water.

In particular, if the apparatus is provided for multiple use, provision can expediently be made for a third connection to fill the cleaning substance. A user can then refill the cleaning substance without having to disassemble the apparatus between the external and internal water line.

A multiway valve can advantageously also be provided in such an apparatus, which, in a first position, inserts the chamber between the inlet connection and outlet connection of the apparatus and in a second position connects the inlet connection and outlet connection by bypassing the chamber. Such a multiway valve prevents water from escaping out of the lines via the third connection if this is open in order to refill the chamber.

The subject matter of the invention is also a household appliance with an internal water line, which is arranged upstream of an apparatus of the afore-described type.

An apparatus for cleaning the internal water line may also be fixedly integrated in a household appliance. The connections of the chamber and the internal water line which complement one another may then be omitted. In order to be able to refill the cleaning substance in a user-friendly and safe manner, the afore-cited multiway valve is expediently present.

BRIEF DESCRIPTION OF THE DRAWINGS

Further features and advantages of the invention result from the subsequent description of exemplary embodiments with reference to the appended figures, in which.

DETAILED DESCRIPTION OF EXEMPLARY EMBODIMENTS OF THE PRESENT INVENTION

Figure 1:
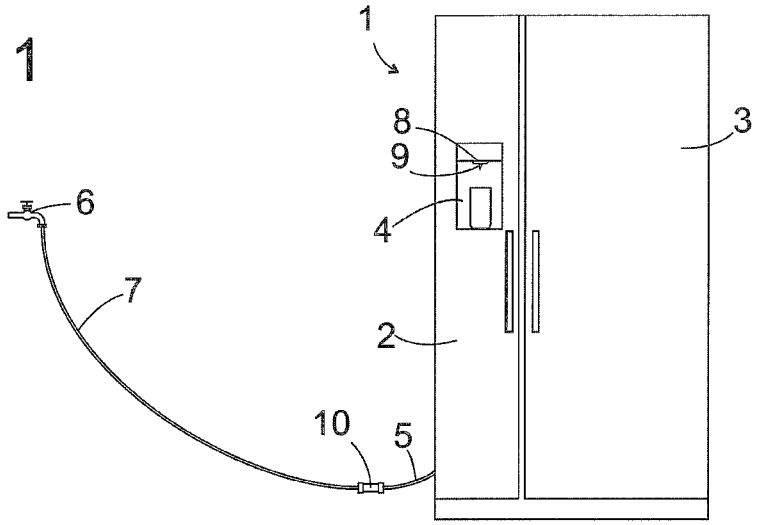
FIG. 1 shows a schematic representation of a refrigerating device, which is cleaned with the inventive method.

FIG. 1 shows a household appliance 1 of the type known per se, here a side-by-side combination device with two refrigeration chambers with different widths disposed adjacent to one another, here closed by a door 2, 3 in each instance. A recess 4 for a cold water dispenser is recessed into the door 2. An automatic ice maker (not shown) is accommodated in an upper region of the refrigeration chamber disposed behind the door 1 and held at below 0° C. during operation, and an ejection channel 8 for ice pieces generated by the ice maker opens into the recess 4. A cold water tank which supplies the cold water dispenser is embedded in a frost-free manner in an insulation layer of the door 2 and is connected to an outlet 9 on the ceiling of the recess 4. The ice maker and the cold water tank are supplied by an internal water line of the device 1, which is partially fixedly placed in the apparatus 1 and one part of which is formed by a tube 5, the upstream end of which is shown extracted from the refrigerating device 1 in the Figure. A cleaning apparatus 10 is inserted between the tube 5 of the apparatus and an external tube 7 connected to a water tap 6.

Figure 2:
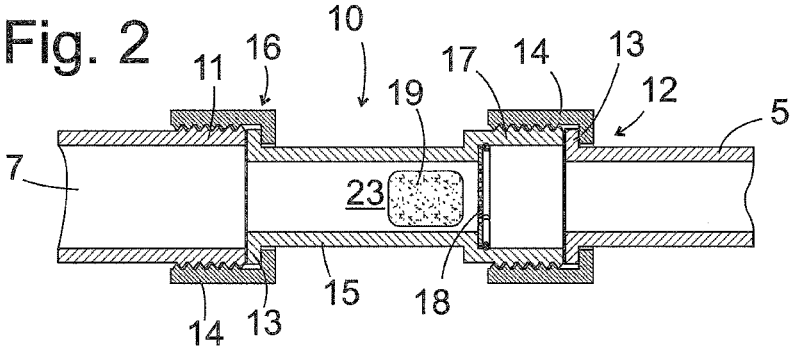
FIG. 2 shows a first embodiment of the inventive apparatus, mounted between an external water line and an internal water line of the refrigerating device.

FIG. 2 shows the cleaning apparatus 10 and connections 11, 12 of the tubes 5, 7 connected thereto in a longitudinal section. The connection 11 of the external tube 7 has an outer thread, the connection 12 of the tube 5 on the apparatus side has an annular flange 13 and a rotatable sleeve 14 put over the annular flange 13 with an inner thread which matches the thread of the connection 11. The connections 11, 12 can therefore be directly connected to one another if the cleaning apparatus 10 is not present.

The cleaning apparatus 10 mounted between the connections 11, 12 itself includes a short tubular piece 15, which delimits a chamber 23 and, at the ends of the tubular piece 15, an inlet connection 16 similar in structure to the connection 12 and/or an outlet connection 17 similar in structure to the connection 11. A filter 18 crossing the tubular piece 15 is mounted adjacent to the outlet connection 17. The filter 18 prevents the detergent tablet 19 fixedly inserted into the tubular piece 15 by way of the inlet connection 16 from being flushed through by water flowing therethrough.

In order to clean the internal water line of the refrigerating device 1, a user closes the water tap 6, separates the connections 11, 12 from one another and therebetween mounts the cleaning apparatus 10 together with the detergent tablet 19 positioned in its chamber 23. The user can put the tablet 19 into the cleaning apparatus 10 him/herself. It is also conceivable to market the cleaning apparatus 10 equipped with the tablet 19, wherein at least the inlet connection 16 is expediently closed, for instance by a film sealing the annular flange 13, which is to be removed at the time of installation, in order to prevent the table 19 from falling out.

Figure 3:
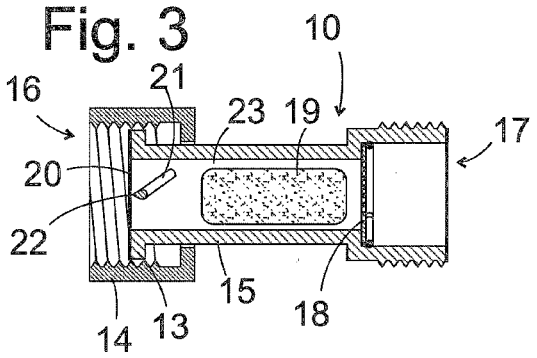
FIG. 3 shows a second embodiment of the apparatus.

A further developed embodiment of the cleaning apparatus 10 is shown in FIG. 3. Here the inlet connection 16 is actually closed by a film 20 sealed on the flange 13. It is however not necessary for the user to remove the film 20 prior to installation of the cleaning apparatus 10 between the tubes 7, 5. A web 21 crossing the inside of the tubular piece 15 has a sharp point 22 facing the film 20. If the cleaning apparatus 10 is mounted and the water tap 6 is opened, the water pushes the film 20 against the point 22 so that the film 20 rips and the water can flow.

Figure 4:
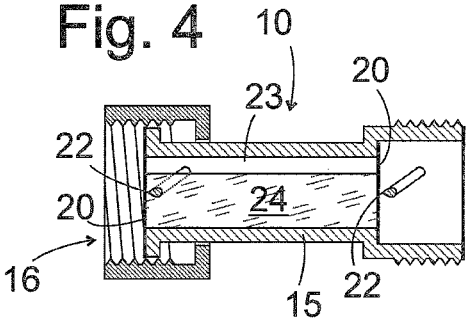
FIG. 4 shows a third embodiment of the apparatus.

FIG. 4 shows a further embodiment of the cleaning apparatus 10, in which the chamber 23 inside the tubular piece 15 is closed on two sides by films 20. A sharp point 22 faces both films, said point causing the film 20 to rip in the event of sufficient pressure prevailing on the sides of the inlet connection 16. Since the films 20, provided they are intact, tightly close the chamber 23, a liquid cleaning agent 24 can be used here instead of the detergent tablet 19. This is quickly flushed out of the chamber 23 after the film 10 is ripped and passes through the internal water line at a high concentration. A relatively small amount of liquid passing therethrough in a short period of time is therefore sufficient to implement a cleaning process.

Figure 5:
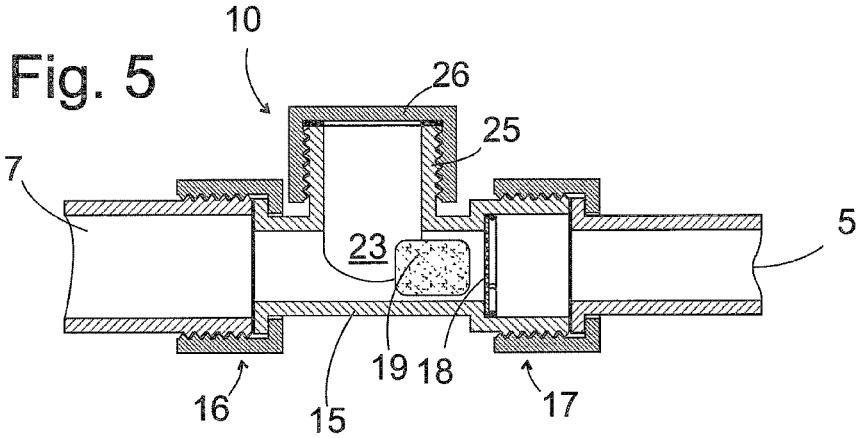
FIG. 5 shows a fourth embodiment of the apparatus.

FIG. 5 shows an embodiment of the cleaning apparatus 10, which is provided in particular for permanent use between the tubes 5, 7. A third connection 25 is arranged at a right angle to the inlet and outlet connection 16, 17 on the tubular piece 15 and is closed by a screwed-on cover 26. It is sufficient here to unscrew the cover 26 in order to be able to insert a detergent table 19 into the inner chamber 23 of the cleaning apparatus 10.

Figure 6:
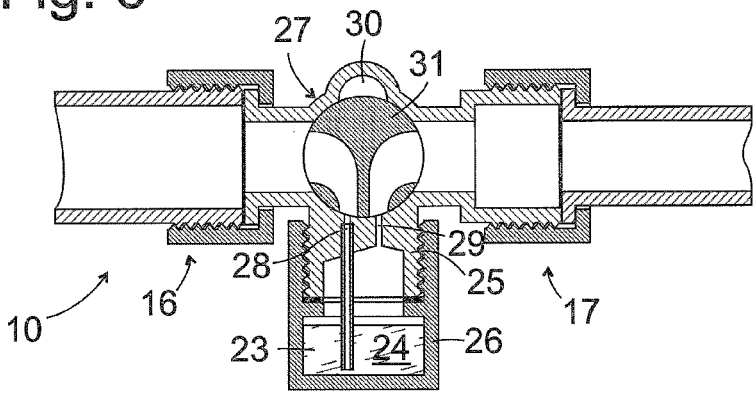
FIG. 6 shows a fifth embodiment of the apparatus.

A further development of the embodiment from FIG. 5 is shown in FIG. 6. A multiway valve 27 is arranged between the connections 16, 17, 25. A chamber 23, which can receive liquid or also solid detergent 24, is formed in the cover 26 screwed against the connection 25 from below. The multiway valve 27 is shown in a position in which it guides water through a bottleneck 28 into the chamber 23 and the water mixed with the detergent 24 flows via a second bottleneck 29 to the outlet connection 17. The bottlenecks 28, 29 delimit the water flow rate and therefore provide for an adequate dwell time of the detergent 24 in the internal water line.

After the cleaning process has been implemented, a closing element 31 of the multiway valve 27 is rotated by 180° C. so that its inner channels open onto a protrusion 30 lying opposite the chamber 23. Its free cross-section is clearly larger than that of the bottlenecks 28, 29, so that in this position water can flow essentially unhindered through the apparatus 10.

In this position of the multiway valve 27, the chamber 23 is decoupled from the water flow. The cover 26 can therefore be unscrewed and refilled without water being able to escape. Preparation of a cleaning process therefore does not require closure of the water tap 6, which is then particularly advantageous if this is concealed by the refrigerating device 1.

Figure 7:
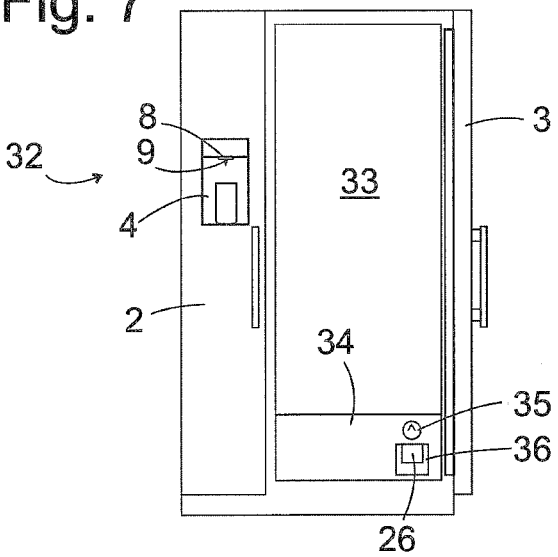
FIG. 7 shows a schematic view of a refrigerating device having a fixedly installed cleaning apparatus according to the invention.

FIG. 7 shows a schematic view of a refrigerating device 31 having a fixedly integrated cleaning apparatus 10 of the type shown in FIG. 6. The refrigerating device 32 is a side-by-side combination device like that shown in FIG. 1. It is shown with an open door 3; for the sake of clarity the normal cooling chamber 33 arranged therebehind is shown without built-in components. The depth of the normal cooling chamber 33 is reduced in its lower region by a projection 34, behind which a compressor recess which opens to the rear of the device is found in a known manner. The cleaning apparatus 10 is also accommodated in the projection 24. A rotary button 35 for actuating the multiway valve 27 and the cover 26 screwed from below against the multiway valve in a recess 26 are also visible to a user. The user can access the cover 26 and fill it with detergent without having to move the refrigerating device 31 herefor or having to access its connection to the water tap 6.

The invention claimed is:

1. An apparatus for cleaning an internal water line of a household appliance, comprising:

a tubular piece;

a chamber defined in the tubular piece and structured to contain a cleaning substance;

an inlet connection positioned on the tubular piece upstream of the chamber with respect to a direction of a flow of water supplied by a mains water supply;

an outlet connection positioned on the tubular piece downstream of the chamber with respect to the direction of the flow of water supplied by the mains water supply; and a destructible membrane positioned inside of the outlet connection and downstream of the chamber with respect to the direction of the flow of water supplied by the mains water supply, wherein the chamber, the inlet connection, and the outlet connection are arranged such that the entire flow of water supplied by the mains water supply passes through the chamber, and wherein the destructible membrane is configured to be destroyed by pressure applied by the flow of water supplied by the mains water supply.

2. The apparatus of claim 1, further comprising a third connection in communication with the chamber configured to receive the cleaning substance for addition into the chamber.

3. The apparatus of claim 1, further comprising an additional destructible membrane positioned upstream of the chamber.

4. The apparatus of claim 3, further comprising at least one web having a sharp point, each at least one web corresponding to one destructible membrane, and each at least one web positioned downstream of the corresponding destructible membrane.

5. The apparatus of claim 1, further comprising a cleaning substance provided to the chamber, the cleaning substance being either liquid or solid.

6. The apparatus of claim 5, wherein if the cleaning substance is liquid, the destructible membrane positioned is downstream of the chamber.

7. A system for supplying a cleaning substance, comprising:

a tubular piece;

a chamber defined in the tubular piece and structured to contain the cleaning substance;

an inlet connection positioned on the tubular piece upstream of the chamber with respect to a direction of a flow of water supplied by a mains water supply;

an outlet connection positioned on the tubular piece downstream of the chamber with respect to the direction of the flow of water supplied by the mains water supply; and a destructible membrane positioned within the outlet connection and downstream of the chamber with respect to the direction of the flow of water supplied by the mains water supply, wherein the chamber, the inlet connection, and the outlet connection are arranged such that the entire flow of water supplied by the mains water supply passes through the chamber, and wherein the destructible membrane is configured to be destroyed by pressure applied by the flow of water supplied by the mains water supply.

8. The system of claim 7, further comprising a household appliance.

9. The system of claim 7, further comprising a third connection in communication with the chamber configured to receive the cleaning substance for addition into the chamber.

10. The system of claim 8, wherein the chamber is positioned internally or externally of the household appliance.

11. The system of claim 8, wherein the household appliance further comprises a refrigerating device.

12. The system of claim 7, wherein an additional destructible membrane is positioned upstream of the chamber.

13. The system of claim 12, further comprising at least one web having a sharp point, each at least one web corresponding to one destructible membrane, and each at least one web positioned downstream of the corresponding destructible membrane.

14. The system of claim 7, further comprising a cleaning substance provided to the chamber, the cleaning substance being either liquid or solid.

15. The system of claim 14, wherein if the cleaning substance is liquid, the destructible membrane positioned is downstream of the chamber.

16. A system for supplying a cleaning substance, comprising:

an internal water line configured to convey a flow of water in a direction supplied by a mains water supply;

an apparatus connected to the internal water line and positioned upstream of the internal water line to clean the internal water line, said apparatus comprising:

a tubular piece, a chamber defined in the tubular piece and structured to contain the cleaning substance, an inlet connection positioned on the tubular piece upstream of the chamber with respect to the direction of the flow of water supplied by the mains water supply, an outlet connection positioned on the tubular piece downstream of the chamber with respect to the direction of the flow of water supplied by the mains water supply, and a multi way valve switchable between a first position in which the entire flow of water supplied by the mains water supply passes through the chamber to the internal water line, and a second position in which the entire flow of water supplied by the mains water supply bypasses the chamber.

17. The system of claim 16, further comprising a household appliance, wherein the apparatus is positioned internally or externally of the household appliance.

18. The system of claim 16, wherein the multi way valve comprises an inlet and an outlet, and wherein in the first position the inlet and the outlet are each in fluid communication with the chamber via a bottleneck.

19. The system of claim 16, wherein the tubular piece further comprises a protrusion defining a void such that the entire flow of water supplied by the mains water supply bypasses the chamber through the void.

20. An apparatus for cleaning an internal water line of a household appliance, comprising:

a tubular piece;

a chamber defined in the tubular piece and structured to contain a cleaning substance;

an inlet connection positioned on the tubular piece upstream of the chamber with respect to a direction of a flow of water supplied by a mains water supply;

an outlet connection positioned on the tubular piece downstream of the chamber with respect to the direction of the flow of water supplied by the mains water supply; and a multi way valve switchable between a first position in which the entire flow of water supplied by the mains water supply passes through the chamber to an internal water line of a household appliance, and a second position in which the entire flow of water supplied by the mains water supply bypasses the chamber.

21. The apparatus of claim 20, wherein the multi way valve comprises an inlet and an outlet, and wherein in the first position the inlet and the outlet are each in fluid communication with the chamber via a bottleneck.

22. The apparatus of claim 20, wherein the tubular piece further comprises a protrusion defining a void such that the entire flow of water supplied by the mains water supply bypasses the chamber through the void.

23. An apparatus for cleaning an internal water line of a household appliance, comprising:

a tubular piece;

a chamber defined in the tubular piece and structured to contain a cleaning substance;

an inlet connection positioned on the tubular piece upstream of the chamber with respect to a direction of a flow of water supplied by a mains water supply;

an outlet connection positioned on the tubular piece downstream of the chamber with respect to the direction of the flow of water supplied by the mains water supply;

a filter or a destructible membrane positioned inside of the outlet connection and downstream of the chamber with respect to the direction of the flow of water supplied by the mains water supply; and an additional destructible membrane positioned upstream of the chamber, wherein the chamber, the inlet connection, and the outlet connection are arranged such that the entire flow of water supplied by the mains water supply passes through the chamber.

24. The apparatus of claim 23, further comprising a third connection in communication with the chamber configured to receive the cleaning substance for addition into the chamber.

25. The apparatus of claim 23, further comprising at least one web having a sharp point, each at least one web corresponding to one destructible membrane, and each at least one web positioned downstream of the corresponding destructible membrane.

26. The apparatus of claim 23, further comprising a cleaning substance provided to the chamber, the cleaning substance being either liquid or solid.

27. The apparatus of claim 26, wherein if the cleaning substance is solid, the filter is positioned downstream of the chamber, and wherein if the cleaning substance is liquid, the destructible membrane positioned is downstream of the chamber.

28. A system for supplying a cleaning substance, comprising:

a tubular piece;

a chamber defined in the tubular piece and structured to contain the cleaning substance, an inlet connection positioned on the tubular piece upstream of the chamber with respect to a direction of a flow of water supplied by a mains water supply, and an outlet connection positioned on the tubular piece downstream of the chamber with respect to the direction of the flow of water supplied by the mains water supply, and a filter or a destructible membrane positioned within the outlet connection and downstream of the chamber with respect to the direction of the flow of water supplied by the mains water supply; and an additional destructible membrane is positioned upstream of the chamber, wherein the chamber, the inlet connection, and the outlet connection are arranged such that the entire flow of water supplied by the mains water supply passes through the chamber.

29. The system of claim 28, further comprising a household appliance.

30. The system of claim 28, further comprising a third connection in communication with the chamber configured to receive the cleaning substance for addition into the chamber.

31. The system of claim 29, wherein the chamber is positioned internally or externally of the household appliance.

32. The system of claim 29, wherein the household appliance further comprises a refrigerating device.

33. The system of claim 28, further comprising at least one web having a sharp point, each at least one web corresponding to one destructible membrane, and each at least one web positioned downstream of the corresponding destructible membrane.

34. The system of claim 28, further comprising a cleaning substance provided to the chamber, the cleaning substance being either liquid or solid.

35. The system of claim 34, wherein if the cleaning substance is solid, the filter is positioned downstream of the chamber, and wherein if the cleaning substance is liquid, the destructible membrane positioned is downstream of the chamber.

* * * * *